US005579541A

United States Patent [19]

Christy et al.

[11] Patent Number: 5,579,541

[45] Date of Patent: Dec. 3, 1996

[54] SOCK TABS

[76] Inventors: Louise P. Christy; Frank Saffioti, both of 37/1-3 Princess Street, Brighton-le-sands, New South Wales, 2216, Australia

[21] Appl. No.: 499,550

[22] Filed: Jul. 7, 1995

[30] Foreign Application Priority Data

Mar. 2, 1995 [AU] Australia ..... 13608/95

[51] Int. Cl.[6] ..... A41B 11/00; A41F 1/00

[52] U.S. Cl. ..... 2/239; 2/912; 24/450; 24/DIG. 29

[58] Field of Search ..... 2/239, 919, 912, 2/911, 920, 240; 24/DIG. 29, 450, 452, 442, 446

[56] References Cited

U.S. PATENT DOCUMENTS

| | | | |
|---|---|---|---|
| 2,663,877 | 12/1953 | Bohman | 2/239 |
| 4,058,853 | 11/1977 | Boxer et al. | 2/239 |
| 4,169,324 | 10/1979 | Gibbs | 36/83 |
| 4,975,985 | 12/1990 | Stimpson | 2/90 |
| 5,038,413 | 8/1991 | Ursimo | 2/239 |
| 5,321,855 | 6/1994 | Ciuffo | 2/239 |
| 5,357,660 | 10/1994 | Smith | 2/239 |

FOREIGN PATENT DOCUMENTS 1414128 11/1975 United Kingdom .

*Primary Examiner*—Amy B. Vanatta
*Attorney, Agent, or Firm*—Edwin D. Schindler

[57] ABSTRACT

A pair of socks 11, each sock 11 having a tab 12 attached to it along one edge 13 of the tab 12 with the tab 12 acting as a flap is disclosed. The tab 12 and sock 11 have on their adjacent surfaces, a fastening means comprising a complementary arrangement of hook and pile patches 15*a* and 15*b* which are mateable so that the tab 12 is fastened to the sock 11 when the sock is being worn, and wherein the complementary arrangement of hook and pile patches 15*a* and 15*b* on each tab 12 and sock 11 is also mateable with the complementary arrangement of hook and pile patches 15*a* and 15*b* on the other tab 12 and sock 11.

3 Claims, 3 Drawing Sheets

SOCK TABS

The present invention relates to socks and, in particular, to socks having sock tabs which have complementary fastening devices which enable a pair of socks to be fastened together when not being worn.

BACKGROUND TO THE INVENTION

Many people throughout the world have the problem of misplaced or lost ones of pairs of socks. It is common for one of a pair of socks to be misplaced and therefore render the pair unusable. The single sock could be lost when put out to wash or when being stored. Depending on the habits formed by the person who wears and/or washes the socks, the misplacement of single socks can be a problem which is annoying and possibly expensive if new pairs of socks have to be purchased at relatively short intervals It has recently become fashionable for tabs or tags to be sewn or secured to the outside of clothing to signify its manufacturer or its origins. This practice also extends to the use of tabs or tags which are solely for decorative purposes. The types of clothing on which such tabs are used includes: shirts, jackets, trousers, shoes, socks, underwear, and hats or caps, i.e. all types of clothing.

It is noted that the use of tabs for decoration or as a badge of its origin has previously been used with socks. It is envisaged that such tabs can be used in conjunction with a complementary fastening devices which ensure that the socks can be fastened together when not in use.

It is also noted that it is advantageous for the socks to be joined together when the socks are being washed and dried. In this case, it would be advantageous if the socks can be joined in such a fashion that they can both be hung out to dry while joined together such that pegs or other holding devices need not be used.

One attempt to holding a pair of socks together during laundering or the like is illustrated in U.S. Pat. No. 4,058,853, wherein a flexible patch secured to each sock is used to adhere the them to each other when pressed together. The patches are secured well below the top of the socks and therefore are unable to be used effectively to join the socks together so that they could be hung out to dry whilst joined together without the need for pegs or other holding devices.

OBJECT OF THE INVENTION

The present invention has been conceived out of the need to provide a fastening device for socks in order to overcome or at least ameliorate the above mentioned problem associated with misplaced single socks or to provide an advantageous use of the socks when not being worn. At the very least, the invention provides an alternative to known methods of providing tabs for decoration, or badges of origins, of a pair of socks.

DISCLOSURE OF THE INVENTION

According to the present invention there is provided a pair of socks, each sock having a tab attached to it along one edge of said tab with said tab acting as a flap, said tab having on its surface adjacent said sock, a fastening means which is mateable with a complementary fastening means positioned on the sock so that the tab is fastened to said sock when said sock is being worn, wherein the fastening means on each said tab and said sock is also mateable with the fastening means on the other said tab and said sock, wherein the fastening means on each said tab is mateable with a complementary fastening means on the other said tab, and the fastening means on each said sock is mateable with a complementary fastening means on the other said sock, and.

wherein each said tab is positioned adjacent the top of the corresponding said sock, with the attached edge of said tab being substantially attached along the top of said sock with one said tab being attached on one side of one of the socks with the other said tab being attached on the other side of the other said sock, wherein the tabs are pivotable in their open flap position with said socks being aligned next to each other. Preferably, the fastening means on each said tab are complementary hook and pile patches and the tabs have patches thereon.

BRIEF DESCRIPTION OF THE DRAWINGS

One embodiment of the present invention will now be described with reference to the drawings in which.

BEST MODE OF CARRYING THE INVENTION

Figure 1:
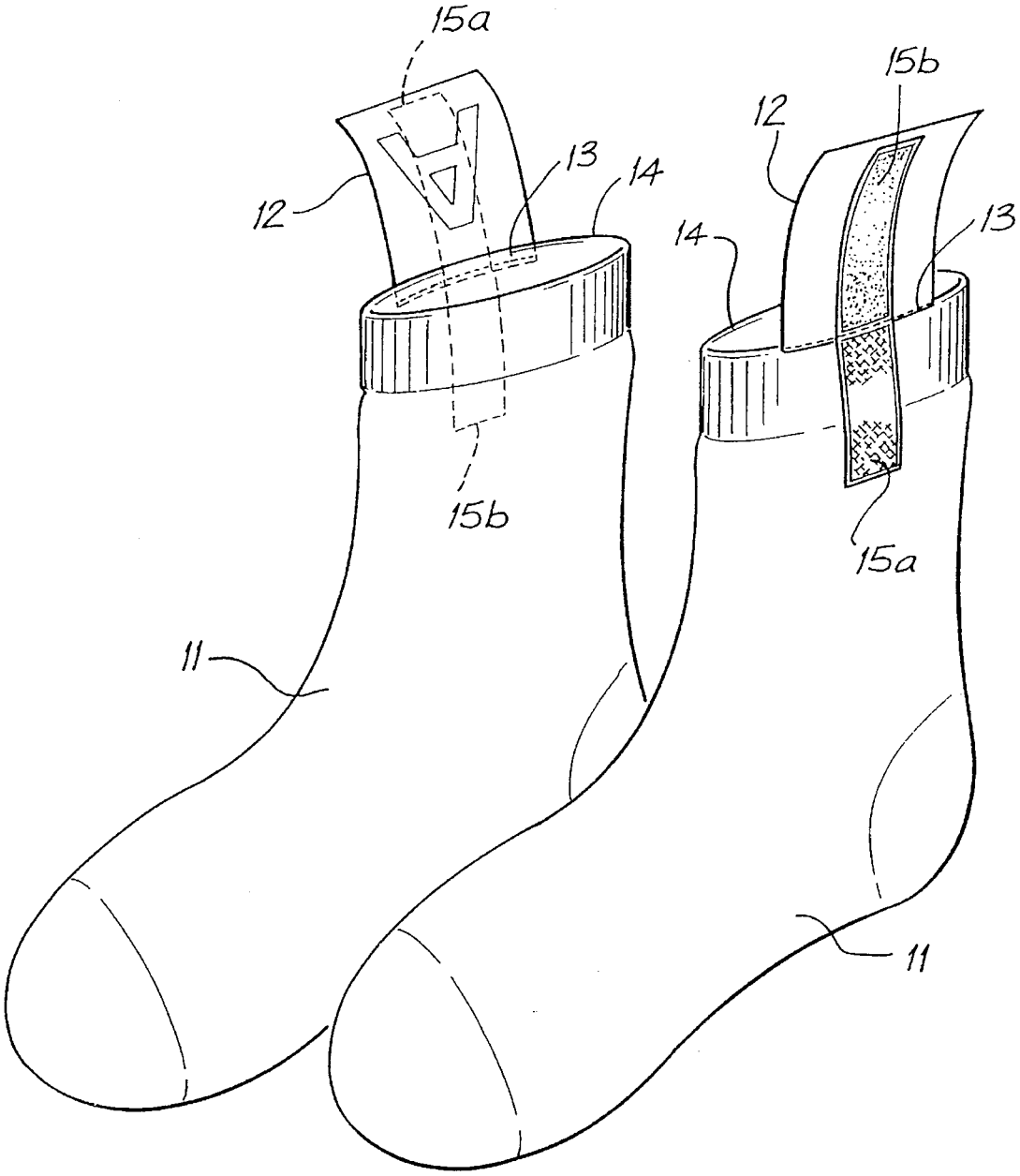
FIG. 1 is a front perspective view of a pair of socks having sock tabs of a first embodiment, shown with the sock tabs unfastened to the socks.

Referring to the figures generally, a pair of socks 11 of a preferred embodiment is illustrated. Each sock 11 has a tab 12 sewn along its top edge 13 and thereby attached to the sock 11 adjacent the top 14 of the sock 11. It is seen that the tabs 12 are attached to different sides of each sock 11, with the preferred wearing style being with the tabs 12 positioned on the outward side of both socks 11 when worn by the wearer. Both tabs 12 act as flaps from the top 14 of the sock 11. It is noted that the tabs 12 are preferably decorative or are a badge of origin of the socks, i.e. includes a trade mark.

Figure 2:
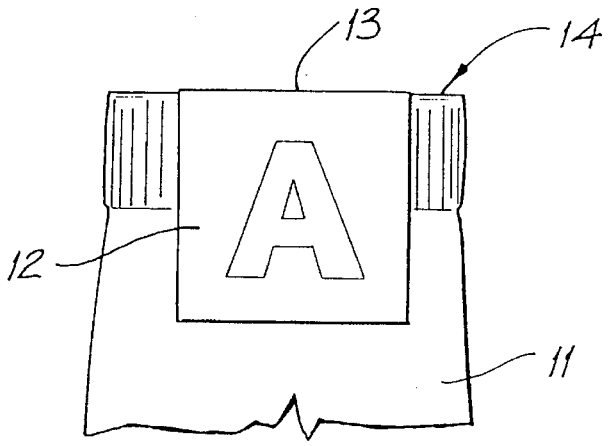
FIG. 2 is a partial front view of one of the sock tabs of the pair of socks of FIG. 1 shown with the tab fastened to the sock.

A complementary fastening device such as velcro® patches **15*a* and 15*b* are attached to the socks 11 and tabs 12. When the socks 11 are being worn, the complementary velcro® patches 15*a* and 15*b* are fastened together with the tab 12 effectively fastened to the sock 11 as illustrated in FIG. 2. In the embodiment as illustrated in the drawings, the right sock 11 has the velcro® patch 15*a* with the hooks while the tab 12 on the right sock 12 has the velcro® patch 15*b* with the fibres, whilst the left sock 11 has the opposite configuration. This means that the velcro® patches 15*a* and 15*b* attached to the sock 11 and tab 12 of the right sock 11 are complementary to the velcro® patches 15*a* and 15*b* attached to the tab 12 and sock 11 of the left sock 11**, respectively.

Figure 3:
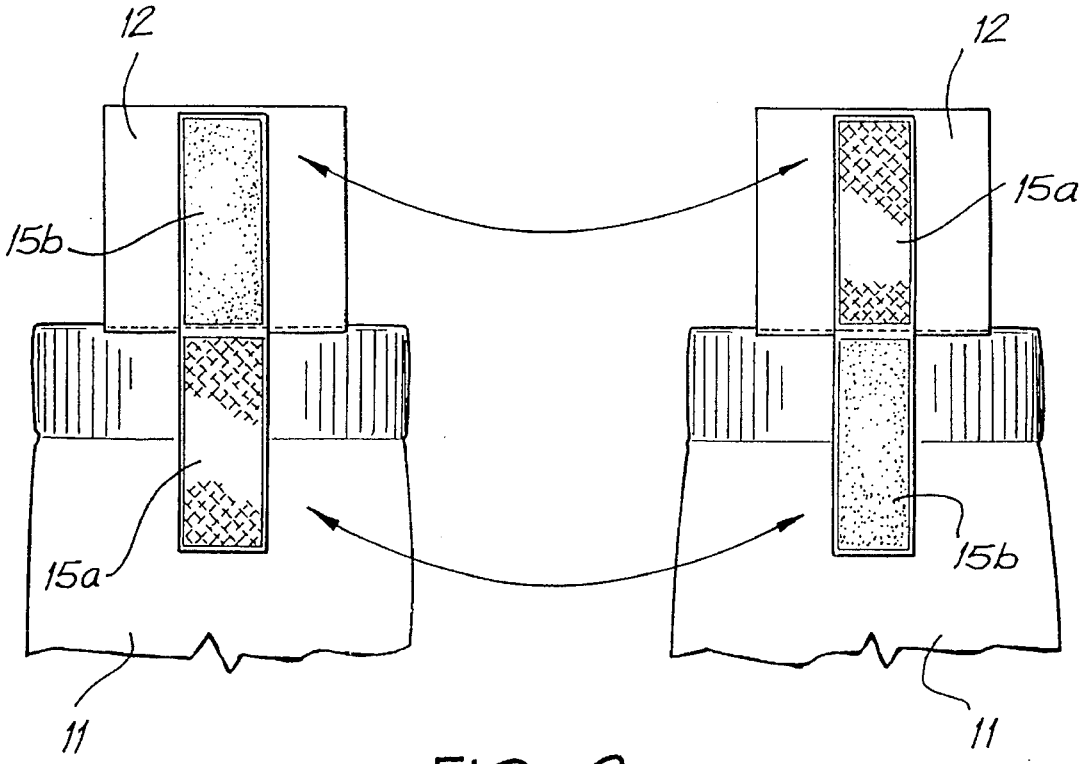
FIG. 3 is a partial front view of the pair of socks of FIG. 1 showing the fastening arrangement between the pair of socks.
Figure 4:
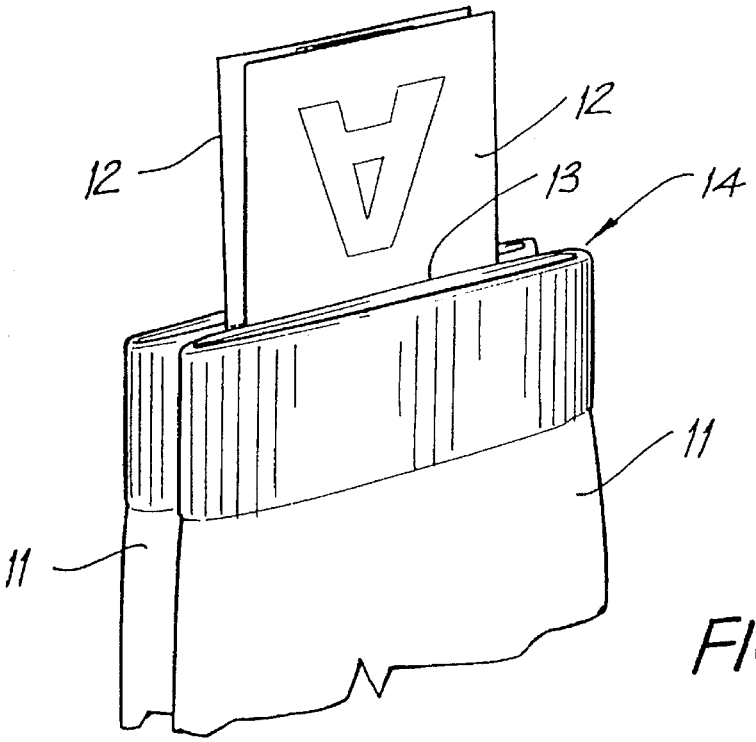
FIG. 4 is a front perspective view of the pair of socks of FIG. 1 shown with the socks fastened together.
Figure 5:
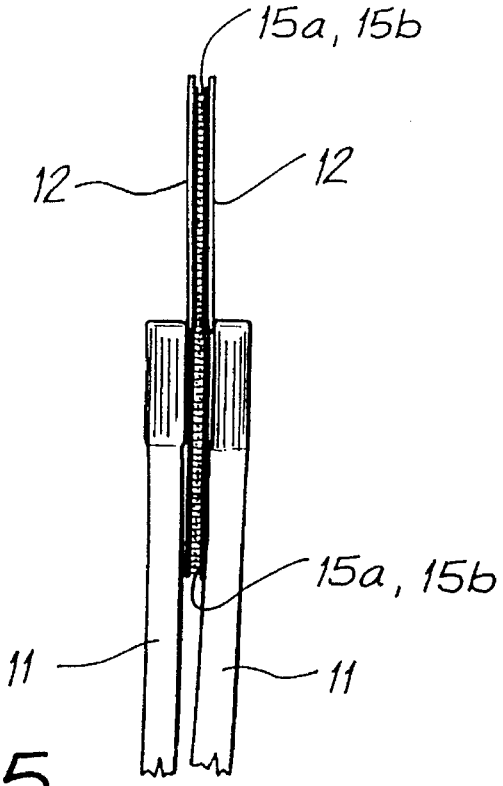
FIG. 5 is a partial side view of the pair of socks of FIG. 1 shown with the socks fastened together.

The aforementioned arrangement allows the socks 11 to be fastened together when not being worn as shown in FIGS. 3 and 4. In this embodiment, both tabs 12 are fastened together whilst both socks 11 are also fastened together due to the complementary arrangement of the velcro® patches **15*a* and 15*b*. In this particular arrangement it is seen that the two socks 11 are fastened together with the tabs 12 protruding upwardly from the tops 14 of the socks 11 with the socks 11 positioned along side of the other. This arrangement is useful for hanging the socks out to dry on a line after washing without the need to use pegs or other such devices. It will be appreciated that the socks 11 can be dried together as well as washed together to help prevent one of the pair of socks 11** from being misplaced.

The present invention has the advantages that the socks 11 can be fastened together all the time that they are not being worn and that the tabs 12 effectively cover the velcro® patches 15*a* and 15*b* when the socks 11 are being worn which prevents other material or foreign matter from being entangled in the velcro® patches 15*a* and 15*b*. The tabs 12 have the added advantage that they can be decorative or include trade marks which is desirable by some manufacturers.

The foregoing describes only one embodiment of the invention and modifications obvious to those skilled in the art can be made thereto without departing from the scope of the present invention.

We claim:

1. A pair of socks, each sock having a tab attached to it along a top edge of said sock with said tab acting as a flap, said tab having on its surface adjacent said sock, fastening means which is mateable with a complementary fastening means positioned on the sock so that said tab is fastened to said sock when said sock is being worn, wherein said fastening means on each said tab and said sock is also mateable with said fastening means on the other said tab and said sock, wherein said fastening means on each said tab is mateable with a complementary fastening means on the other said tab, and said fastening means on each said sock is mateable with a complementary fastening means on the other said sock, and wherein each said tab is positioned along the top edge of the corresponding said sock, with the attached edge of said tab being substantially attached along the top edge of said sock with one said tab being attached on one side of one of the socks with the other said tab being attached on the other side of the other said sock, wherein said tabs are pivotable in their open flap position with said socks being aligned next to each other.

2. The socks as claimed in claim 1, wherein said fastening means are complementary hook and pile patches.

3. The socks as claimed in claim 1 wherein said tabs have decorations thereon.

* * * * *